US005161522A

United States Patent [19]

Clevenger

[11] Patent Number: 5,161,522

[45] Date of Patent: Nov. 10, 1992

[54] THERAPEUTIC SWING FOR HANDICAPPED PERSONS

[76] Inventor: Dennis L. Clevenger, Rte. 2, Box 98, Galena, Mo. 65656

[21] Appl. No.: 706,341

[22] Filed: May 28, 1991

[51] Int. Cl.[5] ..... A61H 1/00

[52] U.S. Cl. ..... 128/25 R; 128/845; 128/876; 472/118; 482/69; 297/410; 297/467; 297/484

[58] Field of Search ..... 128/25 R, 871, 876, 128/845; 606/241; 472/118; 482/66-69; 297/410, 467, 468, 484

[56] References Cited

U.S. PATENT DOCUMENTS

| | | | |
|---|---|---|---|
| 767,774 | 8/1904 | Stoyer | 482/69 |
| 1,297,800 | 3/1919 | Cranford | 482/66 X |
| 1,390,502 | 9/1921 | Clouser | 297/467 X |
| 2,267,103 | 12/1941 | Ireland | 297/410 X |
| 3,761,126 | 9/1973 | Mulholland | 297/467 |
| 3,992,057 | 11/1976 | Studebaker | 297/467 |
| 4,014,540 | 3/1977 | Caulkins | 472/118 X |
| 4,304,437 | 12/1981 | Longo | 472/118 X |
| 4,541,425 | 9/1985 | Yetter, Jr. | 128/876 |
| 4,617,919 | 10/1986 | Suhre | 128/845 X |
| 4,647,066 | 3/1987 | Walton | 297/284 X |
| 4,652,053 | 3/1987 | Mikami | 297/484 |
| 4,732,423 | 3/1988 | Condon | 297/284 |
| 4,844,452 | 7/1989 | Tomosky et al. | 482/66 X |

*Primary Examiner*—Randall L. Green
*Assistant Examiner*—Mary Beth O. Jones
*Attorney, Agent, or Firm*—Kokjer, Kircher, Bowman & Johnson

[57] ABSTRACT

A swing which allows neuromuscular handicapped persons to assume a normal sitting position and to receive good vestibular therapy. The swing has a chair formed by a rigid shell equipped with cushions. The chair is suspended on four ropes which attach to the top edge of the chair back and to the front edges of its sides. The ropes attach at their top ends to a swivel hook mounted on the ceiling or another overhead support. Adjustable head support pads on the back of the chair keep the neck of the occupant from bending unduly and hold the head in place. An adjustable leg support pad on the seat is straddled by the legs of the occupant.

18 Claims, 2 Drawing Sheets

THERAPEUTIC SWING FOR HANDICAPPED PERSONS

BACKGROUND AND SUMMARY OF THE INVENTION

This invention relates generally to swings and more particularly to a swing which is constructed to provide therapy for persons having severe neuromuscular dysfunctions and other handicaps.

It is the principal object of the invention to provide a swing for supporting handicapped children and young adults who cannot sit normally by themselves due to their handicap.

Another important object of the invention is to provide a swing which supports handicapped persons in a position for vestibular therapy. The swing has a chair that is suspended on four ropes which attach to a common swivel mounted on a ceiling or other overhead support. This manner of suspension allows the chair to swing back and forth in the normal fashion and also to turn in a controlled rotary manner and to move multidirectionally for appropriate vestibular stimulation.

A further object of the invention is to provide, in a swing of the character described, a head support arrangement for holding the head of the occupant in a stable position and suitable support for the legs of the occupant. The chair is equipped with adjustable head support pads that prevent the head from moving from side to side and with an adjustable leg support pad that the legs straddle in a manner to prevent both legs from moving to one side of the chair. Addition support and safety are provided by a lap belt and a shoulder harness that can be adjusted to accommodate differences in the size of the occupants.

Additional objects of the invention are to provide a swing of the character described which has a sturdy yet lightweight construction, which is useful both indoors and outdoors, and which is constructed in a simple and economical manner.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 5:
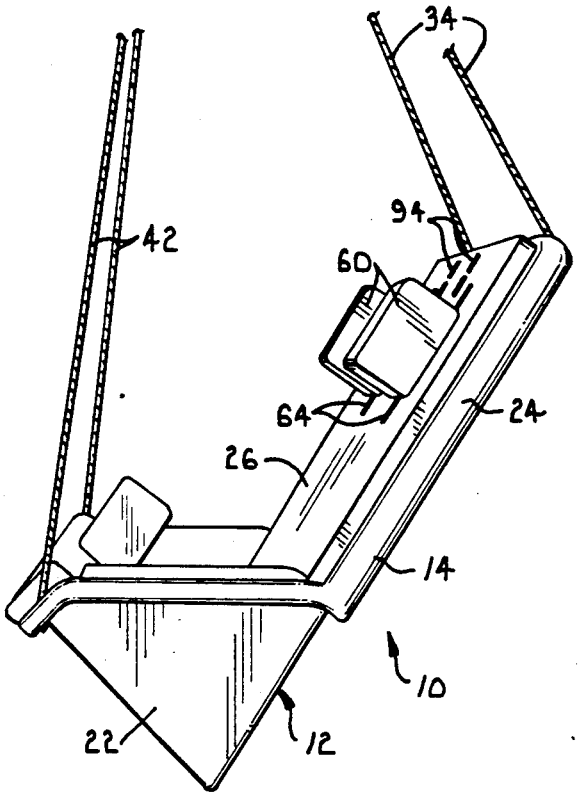
FIG. 5 is a side perspective view of the swing.

Referring now to the drawings in more detail, numeral 10 generally designates a swing which is constructed in accordance with the present invention and which is intended for use primarily by children and young adults having handicaps such as neuromuscular dysfunctions which make them incapable of sitting by themselves in a conventional chair. The body of the swing 10 takes the form of a chair which is generally identified by numeral 12 and which has as its primary structural component a rigid shell 14. The shell 14 may be constructed of fiberglass or another suitable material. The shell 14 includes a flat back panel 16 (FIG. 6), a seat panel 18 (FIG. 1) a leg support panel 20 (FIG. 1) and a pair of opposite side panels 22 (one of which is shown in FIG. 5). A flange 24 extends around the edges of the back panel 14, the side panels 22 and the leg support panel 20. The shell 14 is formed as a single integral piece which includes all of the aforementioned panels and the flange 24. Preferably, the shell is molded. The seat panel 18 extends generally forwardly from the lower edge of the back panel 16, and the leg support panel extends at an angle of approximately 90° from the forward edge of the seat panel 18. The side panels 22 are located on opposite sides of the seat panel 18 and are generally triangular.

Figure 3:
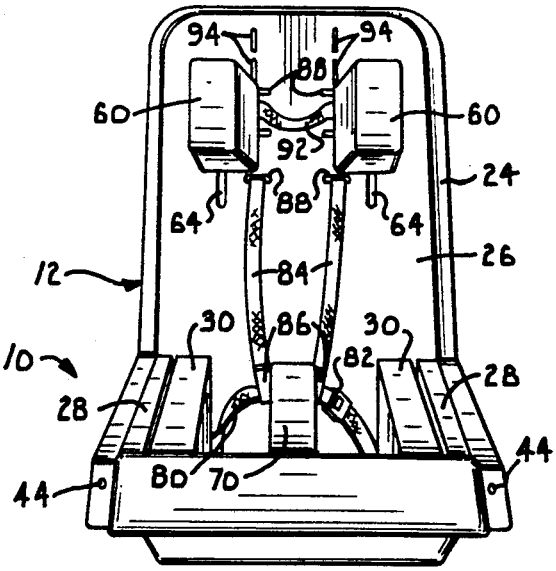
FIG. 3 is a front elevational view similar to FIG. 2, but with all of the components installed.

The back panel 16, seat panel 18 and leg panel 20 are covered by a removable cushion 26 that fits closely within the shell and forms part of the chair 12. The inside surfaces of the opposite side panels 22 of the shell ar lined by removable side cushions 28. Thicker side cushions 30 are also provided and may be placed against the inside surfaces of cushions 28, as shown in FIG. 3. The cushions 30 are removable and are normally used when young children or other small people occupy the chair. The cushions 26 and 28 may be glued or otherwise secured permanently to the shell if desired.

Figure 1:
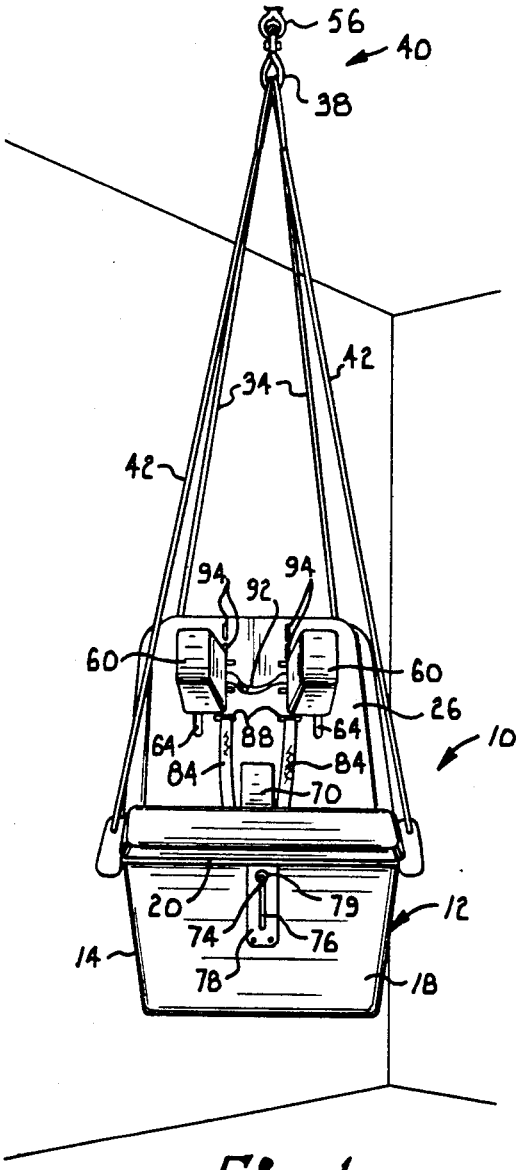
FIG. 1 is a front perspective view showing a swing constructed according to as preferred embodiment of the present invention suspended from a ceiling.
Figure 6:
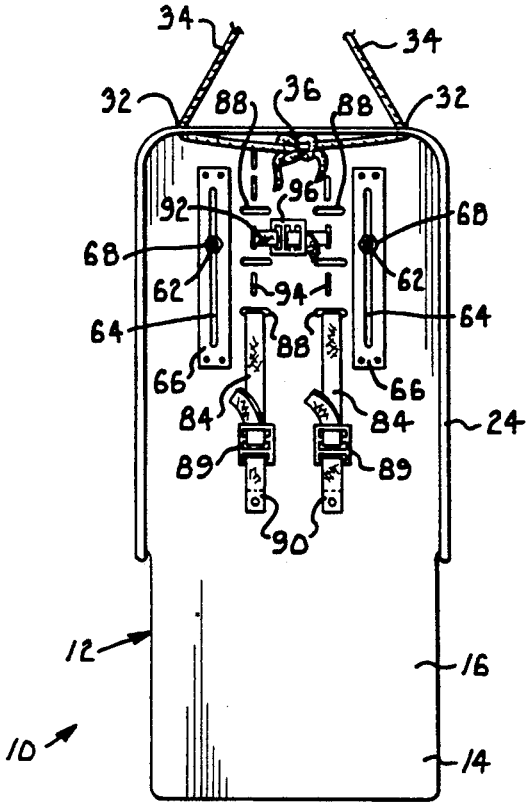
FIG. 6 is a rear elevational view of the swing.

The top edge of the flange 24 is provided with a pair of openings 32 located adjacent to the upper edge of the back panel 14, as best shown in FIG. 6. A pair of flexible ropes 34 are threaded through the openings 32 and may be knotted or otherwise tied together at one end as indicated at 36. As best shown in FIG. 1, the opposite or upper ends of the ropes 34 are provided with loops which are hooked to a hook 38 forming part of a swivel hook generally identified by numeral 40.

Figure 2:
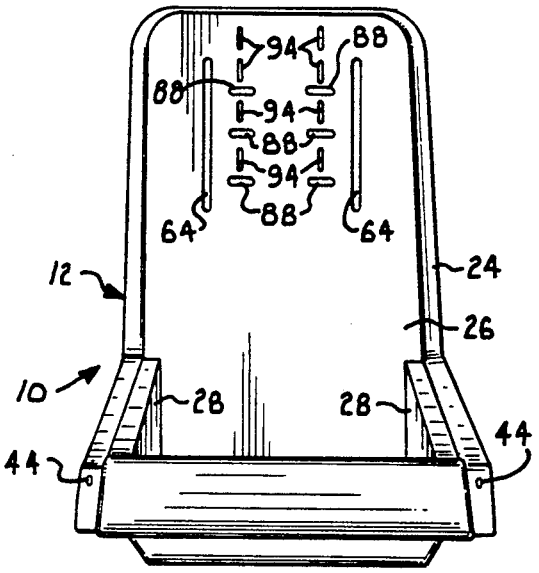
FIG. 2 is a front elevational view of the swing with certain components removed for purposes of clarity.

Another pair of flexible ropes 42 are threaded through openings 44 (see FIGS. 2 and 3) formed through the flange 24 near the front edge of the seat panel 18 adjacent to its junction with the side panels 22. The lower ends of the ropes 42 may be knotted or otherwise tied in a manner to secure the ropes to the chair 12. The upper ends of the ropes 42 are hooked on the hook 38.

Figure 4:
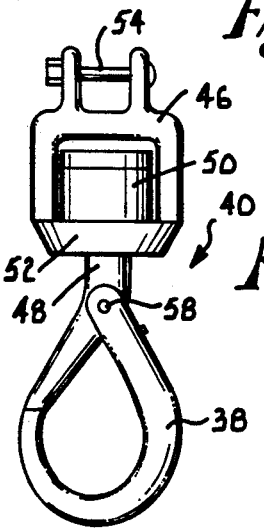
FIG. 4 is a front elevational view of the swivel hook from which the chair may be suspended.

Referring now particularly to FIG. 4, the swivel hook 40 includes a clevis 46 which supports the hook 38 in a manner allowing the hook to turn about a vertical axis. The hook 38 has a shank 48 which carries a bearing 50 at its top end. The bearing rests on and is rotatable relative to a disk 52 carried on the lower end of the clevis 46. The clevis 46 has a removable pin 54 which permits the swivel hook 40 to be connected with a screw eye 56 screwed into a ceiling or to another type of overhead support. The hook 38 may be pivoted open and closed about a pivot pin 58.

Figure 7:
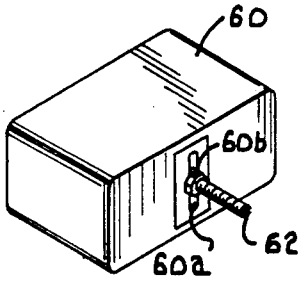
FIG. 7 is a perspective view showing one of the head pads for the swing.
Figure 9:
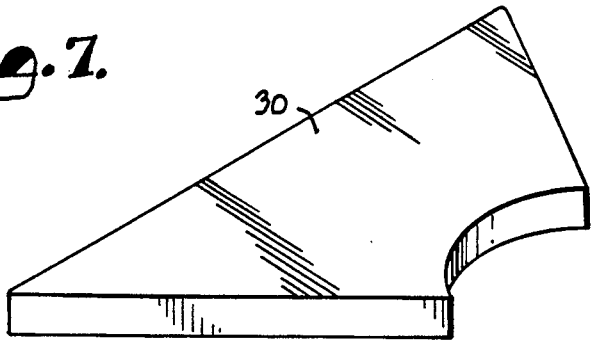
FIG. 9 is a perspective view of one of the side cushions for the swing.

The chair 12 includes a pair of detachable and adjustable head pads 60 which preferably have a relatively soft cushion type material on their exterior surfaces. As best shown in FIG. 7, each head pad 60 has a threaded rod 62 projecting from its base surface. As shown particularly in FIGS. 2, 3 and 6, a pair of slots 64 are formed parallel to one another through the back of the chair 12 and extend through the cushion 26 and the back 14 of the shell. The slots 64 are located on opposite sides of the area where the head of the occupant of the chair is located. Reinforcing plates 66 are secured to the back of panel 16 around the slots 64.

The head pads 60 are applied to the chair by extending the rods 62 through the respective slots 64, adjusting the rods up and down within the slots 64 until the head pads are at the desired location, and applying nuts 68 to the rods 62 and tightening the nuts against the reinforcing plates 66. When the nuts are tightened, the head pads 60 are secured in place. The slots 64 extend generally up and down on the back of the chair to permit pads 60 to be adjusted up and down along the lengths of the slots to accommodate occupants of the chair who may differ in their height. In addition, the pads 60 can be adjusted side to side relative to bolts 62 due to the presence of a lateral slot 60*a* (FIG. 7) in each pad through which the bolt extends. A nut 60*b* which is tightened on bolt 62 may be loosened and retightened after the pad has been slid to one side with bolt 62 moving in the slot 60*a*. In this manner, the pads 60 can be adjusted side to side to accommodate children with different head widths.

Figure 8:
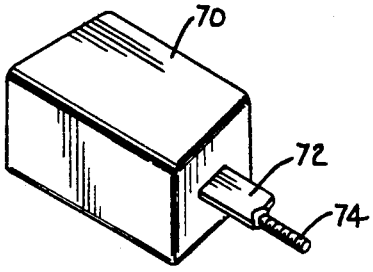
FIG. 8 is a perspective view of the leg support pad for the swing.

A detachable and adjustable leg support pad 70 is provided for the chair 12. Preferably, the leg support pad 70 has a relatively soft outer surface. As best shown in FIG. 8, a flat tab 70 extends from the base end of pad 70, and a threaded rod 74 extends from the tab. The seat of the chair 12 is provided with a slot 76 (see FIG. 1) which is formed through the cushion 26 and the seat panel 18 and which extends generally front to back near the center line of the seat panel. A reinforcing plate 78 is secured to the underside of panel 18 and extends around the slot 76. The leg support pad 70 is applied by extending blade 72 into the slot 76 and moving the pad along the slot to the desired position. The threaded rod 74 projects out of the slot 76, and a nut 79 may be applied to it and tightened in order to secure the pad 70 at the desired location. The relatively close fit of the tab 72 in slot 76 prevents the leg support pad 70 from rotating.

The chair 12 is equipped with a lap belt 80 which is best shown in FIG. 3 and which includes two belts which may be drawn around the lap portion of the occupant of the chair and connected by a buckle 82.

The chair 12 is also equipped with a shoulder harness which includes a pair of flexible straps 84. One end of each strap 84 is formed in a loop 86, and the belt 80 may be extended through the two loops 86. The back of the chair is provided with two sets of slots 88 which are spaced one above the other in each set at location above the location of the shoulders of an occupant of the chair. The straps 84 may be extended through selected slots 88 in the two sets of slots, depending upon the height of the occupant of the chair. As best shown in FIG. 6, the opposite ends of the straps 84 are located behind panel 16 and may be secured by buckles 89 carried on short straps 90 secured to panel 16. The buckles 89 allow the straps 84 of the shoulder harness to be tightened and loosened in order to accommodate occupants of the chair who differ in size.

An optional head restraint system for the chair may include a flexible strap 92 which is threaded through vertically oriented slots 94 arranged in two sets on opposite sides of the head of the occupant of the chair. The slots 94 in each set are spaced vertically apart and extend through the back of the chair so that the belt 92 may be threaded through one slot in each set. As shown in FIG. 6, the belt 92 is provided with a buckle 96 so that the belt 92 may be tightened around the forehead of an occupant of the chair.

In use of the swing 10, the chair 12 is suspended on the four ropes 34 and 42 in the manner shown in FIG. 1. The back of the chair preferably tilts to the rear from bottom to top. The four ropes all converge as they extend upwardly from the chair and suspend the chair from what is essentially a single point located at the hook 38. This manner of suspension of the chair permits it to swing back and forth in the manner of a conventional swing. Additionally, because the hook 38 can rotate about the vertical axis of shank 48, the chair can be rotated, with the swivel hook 40 accommodating the rotation without twisting the ropes 34 and 42. Multidirectional swinging and/or rotational movement of the chair is also permitted due to the manner in which the chair is suspended. The ability of the chair to move back and forth, side to side, rotationally, and in other directions is important, as the multidirectional movement provides good vestibular input which is important therapy for many handicapped persons and particularly those with sever neuromuscular dysfunctions. The locations at which the ropes attach to the chair are important in allowing it to swing properly for vestibular stimulation. The rotary movement can easily be controlled and is important in allowing appropriate vestibular stimulation. The linear, back and forth movement that is permitted of a conventional swing is not as therapeutically effective because the vestibular stimulation is limited.

The handicapped child or young adult who occupies the swing is positioned with his or her head located between the two head support pads 60, with the pads adjusted up and down appropriately to be centered on the head. The head fits rather closely between the two pads such that they are able to hold the head against side to side movement and prevent it from falling unduly off to one side or another. The headband 92 may also be drawn around the forehead in order to maintain the head against the back cushion.

The legs of the occupants straddle the leg support pad 70, and the leg support pad thus prevents both legs from sliding unduly off to one side or another. The calves of the occupant are applied to the portion of cushion 26 that overlies the leg support panel 20, and this assists in maintaining the legs in a normal position assumed by a sitting person. The lap belt 80 and shoulder harness straps 84 help to restrain the occupant and maintain him or her in a normal sitting position.

It is thus evident that the swing provided by the present invention allows severely handicapped children an young adults to assume a normal sitting position and permits movement of the swing that provides good vestibular input having important therapeutic benefits. The swing provides good rotary movement that can be controlled to allow appropriate stimulation. The swing is strong enough to easily handle the weights it receives in normal service, and it is lightweight at the same time. The swing can be mounted to a ceiling or other overhead support at an indoor location, and it can also be used outdoors. The pads 30 can be used if infants or other small children occupy the chair, and they can be removed if the extra room provided without them is needed or desired.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A swing for handicapped persons, comprising:

a swing chair for receiving a handicapped occupant, said chair having a seat and a back extending from the seat and terminating in an upper edge;

opposite sides of said chair located on opposite sides of said seat;

a pair of head support pads spaced apart on said back at locations to receive the head of the occupant therebetween and to hold the head against side to side movement;

a first pair of flexible suspension members having top and bottom ends, said suspension members being connected at the bottom ends thereof with said upper edge of the back;

a second pair of flexible suspension members having top and bottom ends, said suspension members in the second pair being connected at the bottom ends thereof with said opposite sides adjacent a front edge portion of the seat; and swivel means for connecting the top ends of all of said suspension members adjacent to one another on an overhead support in a manner suspending said chair from said support to allow swinging of the chair, said swivel means allowing the chair to rotate without twisting said members.

2. The swing of claim 1, wherein said seat, said back and, said opposite sides each comprise:

a respective panel wherein said panels are all formed as an integral unitary shell; and cushion means on said seat panel, said back panel, and both side panels for cushioning the occupant of the chair.

3. The swing of claim 2, including a leg support panel on said shell extending at an angle from a front edge of said seat panel and cushion means on said leg support panel.

4. The swing of claim 1, including a leg support pad on said seat at a location to be straddled by the legs of the occupant.

5. The swing of claim 4, including means for mounting said leg support and on said seat in a manner allowing said pad to be adjusted front to back thereon.

6. The swing of claim 5, wherein said mounting means comprises:

an elongated slot in said seat extending generally front to back thereon;

a rod on said pad extending through said slot and adjustable along the length thereof; and releasable means for locking said rod against movement along said slot.

7. The swing of claim 1, including means for mounting said head support pads on said back in a manner allowing said pads to be adjusted up and down on the back.

8. The swing of claim 7, wherein said mounting means comprises:

a pair of elongated slots in said back extending generally up and down thereon;

a rod on each pad extending through a corresponding slot and adjustable along the length thereof; and releasable means for locking each rod against movement along its slot.

9. The swing of claim 1, including a lap belt and a shoulder harness for restraining the occupant of the chair.

10. The swing of claim 9, wherein said shoulder harness comprises:

a pair of flexible straps having opposite first and second ends;

a loop on the first end of each strap through which the lap belt may be threaded;

slot means in said back at a location above the shoulders of the occupant through which said straps extend; and means for fastening the second end of each strap to said back at a location behind the chair.

11. The swing of claim 10, wherein said fastening means is adjustable to effect tightening and loosening of the

12. The swing of claim 10, wherein said slot means comprises two sets of slots each including a plurality of slots spaced apart vertically on said back, each slot being adapted to receive one of the straps in extension therethrough.

13. A swing for handicapped persons, comprising:

a swing chair having a seat surface and a back surface for supporting a handicapped occupant, said chair having opposite sides located on opposite sides of said seat surface;

means for suspending said chair from an overhead support in a manner permitting swinging movement of the chair; and a pair of head supports spaced apart on said back surface and arranged to receive the head of the chair occupant therebetween in a manner to hold the head against side to side movement.

14. The swing of claim 13, including means for adjusting said head supports up and down on said back surface.

15. The swing of claim 13, including a leg support on said seat surface at a location to be straddled by the legs of the occupant.

16. The swing of claim 15, including means for adjusting said leg support front to back on said seat surface.

17. The swing of claim 15, including a lap belt and a shoulder harness for restraining the occupant.

18. A swing for handicapped persons, comprising:

a rigid shell having back and seat panels and planar opposite side panels on opposite sides of the seat panel;

cushion means for application to said back and seat panels of the shell to cushion a handicapped occupant;

a pair of side cushions applicable to said side panels for cushioning the occupant;

a leg support pad on said cushion means at a location overlying said seat panel to be straddled by the legs of the occupant;

a pair of spaced apart head support pads on said cushion means at a location forwardly of said back panel to closely receive the head of the occupant therebetween and hold the head against side to side movement; and means for suspending said shell from an overhead support in a manner permitting swinging movement of the shell.

* * * * *